US010450727B2

(12) United States Patent
Collins et al.

(10) Patent No.: US 10,450,727 B2
(45) **Date of Patent: *Oct. 22, 2019**

(54) SYSTEM AND METHOD FOR MONITORING MINING MACHINE EFFICIENCY

(71) Applicant: Harnischfeger Technologies, Inc., Wilmington, DE (US)

(72) Inventors: Matthew R. Collins, Whitefish Bay, WI (US); Kenneth J. Daniel, Libertyville, IL (US); Ray Pan, Oak Creek, WI (US); Michael J. Rikkola, New Berlin, WI (US); Desheng Wang, Brookfield, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 90 days.

This patent is subject to a terminal disclaimer.

(21) Appl. No.: 15/586,364

(22) Filed: May 4, 2017

(65) Prior Publication Data

US 2017/0233985 A1 Aug. 17, 2017

Related U.S. Application Data

(63) Continuation of application No. 13/747,864, filed on Jan. 23, 2013, now Pat. No. 9,650,762.

(Continued)

(51) Int. Cl.
*E02F 9/26* (2006.01)
*G07C 5/08* (2006.01)

(Continued)

(52) U.S. Cl.
CPC ..... *E02F 9/26* (2013.01); *E02F 9/2004* (2013.01); *E02F 9/2054* (2013.01); *E02F 9/264* (2013.01);

(Continued)

(58) Field of Classification Search
CPC . E02F 9/2054; E02F 9/26; E02F 9/264; E02F 9/267
See application file for complete search history.

(56) References Cited

U.S. PATENT DOCUMENTS 4,839,835 A 6/1989 Hagenbuch
7,765,039 B1 7/2010 Hagenbuch (Continued)

FOREIGN PATENT DOCUMENTS

CA 2637425 A1 1/2009
CN 101027617 A 8/2007

(Continued)

OTHER PUBLICATIONS

Office Action issued by the Canadian Patent Office for related Application No. 2,803,313 dated Aug. 17, 2018 (4 pages).

(Continued)

*Primary Examiner* — Abby Y Lin
*Assistant Examiner* — Donald J Wallace
(74) *Attorney, Agent, or Firm* — Michael Best & Friedrich LLP

(57) ABSTRACT

A mining machine including a power monitor, a sensor, and a monitoring module. The power monitor is configured to measure a received power, and generate a total power consumption data based on the received power. The sensor senses payload of the mining machine to generate payload data. The monitoring module includes non-transitory computer readable media for comparing the total power consumption data and the payload data to generate mining machine efficiency data, determining an operator performance comparing the mining machine efficiency data and the operator performance, determining, based on the comparison of the mining machine efficiency data and the operator performance, at least one selected from the group (Continued)

consisting of a bank difficulty and a bank digability, and outputting the at least one selected from the group consisting of the bank difficulty and the bank digability.

19 Claims, 6 Drawing Sheets

Related U.S. Application Data

(60) Provisional application No. 61/590,198, filed on Jan. 24, 2012.

(51) Int. Cl.

| | |
|---|---|
| ***E02F 9/20*** | (2006.01) |
| ***G07C 5/00*** | (2006.01) |
| *E02F 3/30* | (2006.01) |
| *E02F 3/407* | (2006.01) |
| *E02F 3/46* | (2006.01) |
| *E02F 9/14* | (2006.01) |

(52) U.S. Cl.

CPC ..... *E02F 9/267* (2013.01); *G07C 5/008* (2013.01); *G07C 5/085* (2013.01); *G07C 5/0808* (2013.01); *G07C 5/0825* (2013.01); *G07C 5/0841* (2013.01); *E02F 3/301* (2013.01); *E02F 3/304* (2013.01); *E02F 3/4075* (2013.01); *E02F 3/46* (2013.01); *E02F 9/14* (2013.01); *E02F 9/2016* (2013.01)

(56) References Cited

U.S. PATENT DOCUMENTS

| | | | |
|---|---|---|---|
| 8,532,867 | B1 | 9/2013 | Hagenbuch |
| 8,660,738 | B2 | 2/2014 | Faivre et al. |
| 2005/0081410 | A1 | 4/2005 | Furem et al. |
| 2006/0090378 | A1 | 5/2006 | Furem |
| 2008/0282583 | A1 | 11/2008 | Koellner et al. |
| 2009/0018718 | A1 | 1/2009 | Lang et al. |
| 2011/0029279 | A1 | 2/2011 | McAree et al. |
| 2011/0282626 | A1 | 11/2011 | Rikkola et al. |
| 2013/0110460 | A1 | 5/2013 | Taylor |
| 2013/0190966 | A1 | 7/2013 | Collins et al. |

FOREIGN PATENT DOCUMENTS

| | | | |
|---|---|---|---|
| CN | 101418688 | A | 4/2009 |
| CN | 102446246 | A | 5/2012 |
| JP | 2001011901 | A | 1/2001 |

OTHER PUBLICATIONS

First Office Action from the Australian Intellectual Property Office for Application No. 2013200431 dated Jun. 30, 2014 (6 pages).

Second Office Action from the Australian Intellectual Property Office for Application No. 2013200431 dated Jul. 6, 2015 (3 pages).

First Office Action from the State Intellectual Property Office of China for Application No. 201310108078.0 dated Dec. 4, 2015 (64 pages).

Fourth Office Action from the Australian Intellectual Property Office for Application No. 201320043 dated Dec. 22, 2015 (3 pages).

Kwame Awuah-Offei et al., "Cable Shovel Digging Optimization for energy Efficiency," brochure (2007) pp. 995-1006.

First Office Action from the Chilean Intellectual Property Office for Application No. 0242-2013 first known to us dated Jun. 9, 2015 (8 pages, which includes English Statement of Relevance).

Second Office Action from the Chilean Intellectual Property Office for Application No. 0242-2013 first known to us dated Sep. 30, 2015 (7 pages, which includes English Statement of Relevance).

Second Office Action from the State Intellectual Property Office of China for Application No. 201310108078.0 dated Jul. 4, 2016 (22 pages).

Hendricks, "Performance Monitoring of Electric Mining Shovels," thesis (1990) pp. 1-407, Department of Mining and Metallurgical Engineering, McGill University, Montreal.

Office Action from the Chinese Patent Office for Application No. 20171047687.6 dated Sep. 12, 2018 (10 pages including English translation).

Canadian Patent Office Action for Application No. 2803313 dated Jun. 4, 2019 (4 pages).

| Machine | Tons/kWh | Total Power Consumed (kWh) | Max Power Demand (kVA) | Avg. Power Demand (kVA) | Max Voltage (V) |
|---|---|---|---|---|---|
| ES41111 | 213.21 | 504320 | 4608 | 1500.95 | 7581.27 |
| ES41141 | 210.14 | 506250 | 4611 | 1552.98 | 7672.67 |
| ES41198 | 215.9 | 510365 | 4662 | 1488.76 | 7503.48 |
| ES41166 | 208.17 | 2040072 | 4498 | 1590.16 | 7498.26 |
| ES41170 | 217.62 | 505645 | 4709 | 1476.84 | 7615.51 |

455 460 465 470 475 480

450

SYSTEM AND METHOD FOR MONITORING MINING MACHINE EFFICIENCY

RELATED APPLICATIONS

The present application claims priority to U.S. Provisional Application 61/590,198, filed Jan. 24, 2012, which claims priority to U.S. patent application Ser. No. 13/747,864, filed on Jan. 23, 2013, the entire contents both of which is hereby incorporated

BACKGROUND

Embodiments relate to efficiency monitoring for electric mining shovels.

SUMMARY

In one embodiment, the application provides a mining machine comprising a power monitor sensing power consumption of the mining machine during a select time period to generate power consumption data; a sensor sensing payload of the mining machine during the select time period to generate payload data; and a monitoring module. The monitoring module including computer readable media for comparing the power consumption data and the payload data to generate shovel efficiency data, and outputting the shovel efficiency data.

In another embodiment the application provides a method of for monitoring a mining machine. The method comprising receiving data from the mining machine, the data including power consumption data of the mining machine, and payload data of the mining machine. The method further comprising comparing the power consumption data and the payload data to generate shovel efficiency data; and outputting the shovel efficiency data.

In another embodiment, the application provides a mining machine including a power monitor, a sensor, and a monitoring module. The power monitor is configured to measure a received power, and generate a total power consumption data based on the received power. The sensor senses payload of the mining machine to generate payload data. The monitoring module includes non-transitory computer readable media for comparing the total power consumption data and the payload data to generate mining machine efficiency data, determining an operator performance comparing the mining machine efficiency data and the operator performance, determining, based on the comparison of the mining machine efficiency data and the operator performance, at least one selected from the group consisting of a bank difficulty and a bank digability, and outputting the at least one selected from the group consisting of the bank difficulty and the bank digability.

In another embodiment, the application provides a method for monitoring a mining machine. The method includes receiving, via a monitoring module, data from the mining machine, the data including total power consumption data of the mining machine, including a measurement of a received power from an external power source coupled to the mining machine, received from a power monitor, and payload data of the mining machine received from a sensor. The method further includes comparing, via the monitoring module, the total power consumption data and the payload data to generate mining machine efficiency data. The method further includes determining, via the monitoring module, an operator performance, comparing, via the monitoring module, the mining machine efficiency data and the operator performance, and determining, via the monitoring module and based on the comparison of the mining machine efficiency data and the operator performance, at least one selected from the group consisting of a bank difficulty and a bank digability. The method further includes outputting the at least one selected from the group consisting of the bank difficulty and the bank digability. Wherein the mining machine efficiency data is associated with a mining machine operation cycle, the mining machine operation cycle being at least one selected from the group consisting of a hoist, a crowd, and a swing.

In another embodiment, the application provides a monitoring module for monitoring a mining machine. The monitoring module including a memory and a processor. The memory includes a program storage area and a data storage area, the program storage area and the data storage area including at least one of a read-only memory, a random access memory, a flash memory, and a hard disk. The processor executes instructions stored on the memory. The instructions include receiving a total power consumption data from the mining machine, including a measurement of a received power, and receiving payload data from the mining machine. The instructions further include comparing the total power consumption data and the payload data to generate mining machine efficiency data, and determining an operator performance. The instructions further include comparing the mining machine efficiency data and the operator performance, determining, based on the comparison of the mining machine efficiency data and the operator performance, at least one selected from the group consisting of a bank difficulty and a bank digability, and outputting the at least one selected from the group consisting of the bank difficulty and the bank digability.

Other aspects of the application will become apparent by consideration of the detailed description and accompanying drawings.

DETAILED DESCRIPTION

Figure 1:
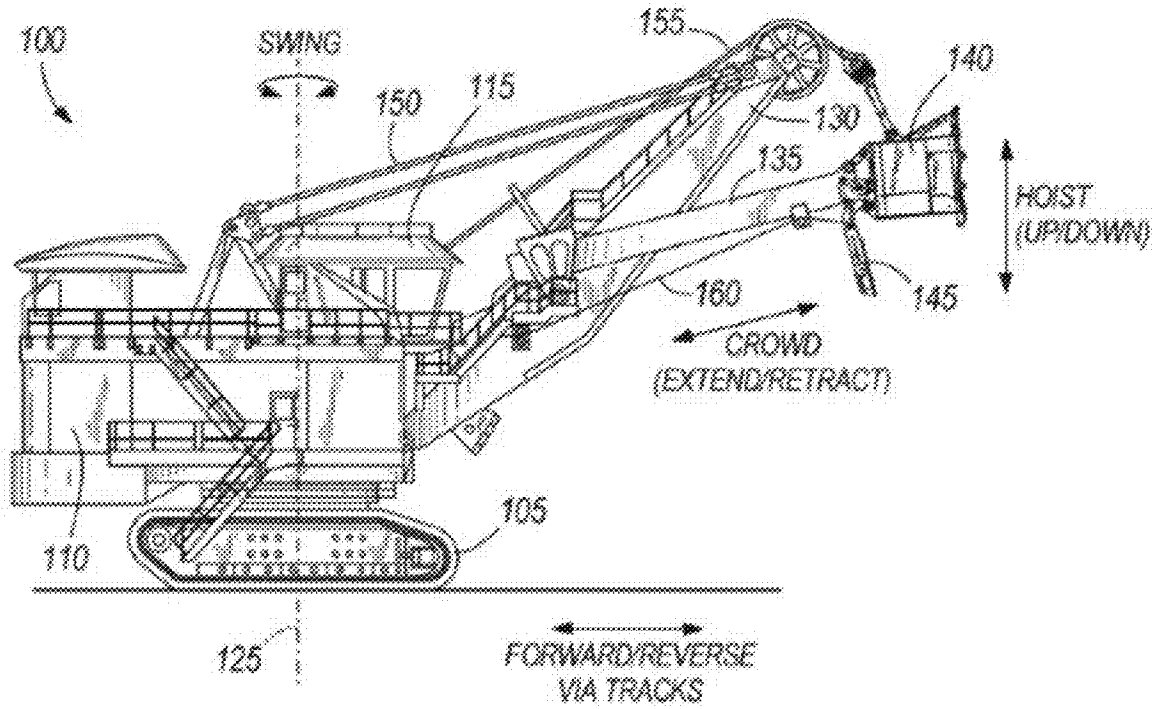
FIG. 1 illustrates an electric mining shovel.

Before any embodiments of the application are explained in detail, it is to be understood that the application is not limited in its application to the details of construction and the arrangement of components set forth in the following description or illustrated in the following drawings. The application is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should also be noted that a plurality of hardware and software based devices, as well as a plurality of different structural components may be used to implement the application. In addition, it should be understood that embodiments of the application may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the application may be implemented in software (e.g., stored on non-transitory computer-readable medium) executable by one or more processors. As such, it should be noted that a plurality of hardware and software based devices, as well as a plurality of different structural components may be utilized to implement the application. Furthermore, and as described in subsequent paragraphs, the specific mechanical configurations illustrated in the drawings are intended to exemplify embodiments of the application and that other alternative mechanical configurations are possible. For example, "controllers" described in the specification can include standard processing components, such as one or more processors, one or more computer-readable medium modules, one or more input/output interfaces, and various connections (e.g., a system bus) connecting the components.

FIG. 1 illustrates an electric mining shovel 100. The embodiment shown in FIG. 1 illustrates the electric mining shovel 100 as a rope shovel, however in other embodiments the electric mining shovel 100 can be a different type of mining machine, for example, a hybrid mining shovel, a dragline excavator, etc. The mining shovel 100 includes tracks 105 for propelling the rope shovel 100 forward and backward, and for turning the rope shovel 100 (i.e., by varying the speed and/or direction of the left and right tracks relative to each other). The tracks 105 support a base 110 including a cab 115. The base 110 is able to swing or swivel about a swing axis 125, for instance, to move from a digging location to a dumping location. Movement of the tracks 105 is not necessary for the swing motion. The rope shovel further includes a dipper shaft 130 supporting a pivotable dipper handle 135 (handle 135) and dipper 140. The dipper 140 includes a door 145 for dumping contents from within the dipper 140 into a dump location, such as a hopper or dump-truck.

The rope shovel 100 also includes taut suspension cables 150 coupled between the base 110 and dipper shaft 130 for supporting the dipper shaft 130; a hoist cable 155 attached to a winch (not shown) within the base 110 for winding the cable 155 to raise and lower the dipper 140; and a dipper door cable 160 attached to another winch (not shown) for opening the door 145 of the dipper 140. In some instances, the rope shovel 100 is a Joy Global Surface Mining® 4100 series shovel produced by Joy Global Inc., although the electric mining shovel 100 can be another type or model of mining equipment.

When the tracks 105 of the mining shovel 100 are static, the dipper 140 is operable to move based on three control actions, hoist, crowd, and swing. The hoist control raises and lowers the dipper 140 by winding and unwinding hoist cable 155. The crowd control extends and retracts the position of the handle 135 and dipper 140. In one embodiment, the handle 135 and dipper 140 are crowded by using a rack and pinion system. In another embodiment, the handle 135 and dipper 140 are crowded using a hydraulic drive system. The swing control swivels the handle 135 relative to the swing axis 125. Before dumping its contents, the dipper 140 is maneuvered to the appropriate hoist, crowd, and swing positions to 1) ensure the contents do not miss the dump location; 2) the door 145 does not hit the dump location when released; and 3) the dipper 140 is not too high such that the released contents would damage the dump location.

The mining shovel 100 is coupled to an external power source for driving components of the mining shovel 100, such as the tracks 105, hoist motors, crowd motors, swing motors etc. The received power is conditioned and filtered to satisfy the power needs of the mining shovel 100.

Figure 2:
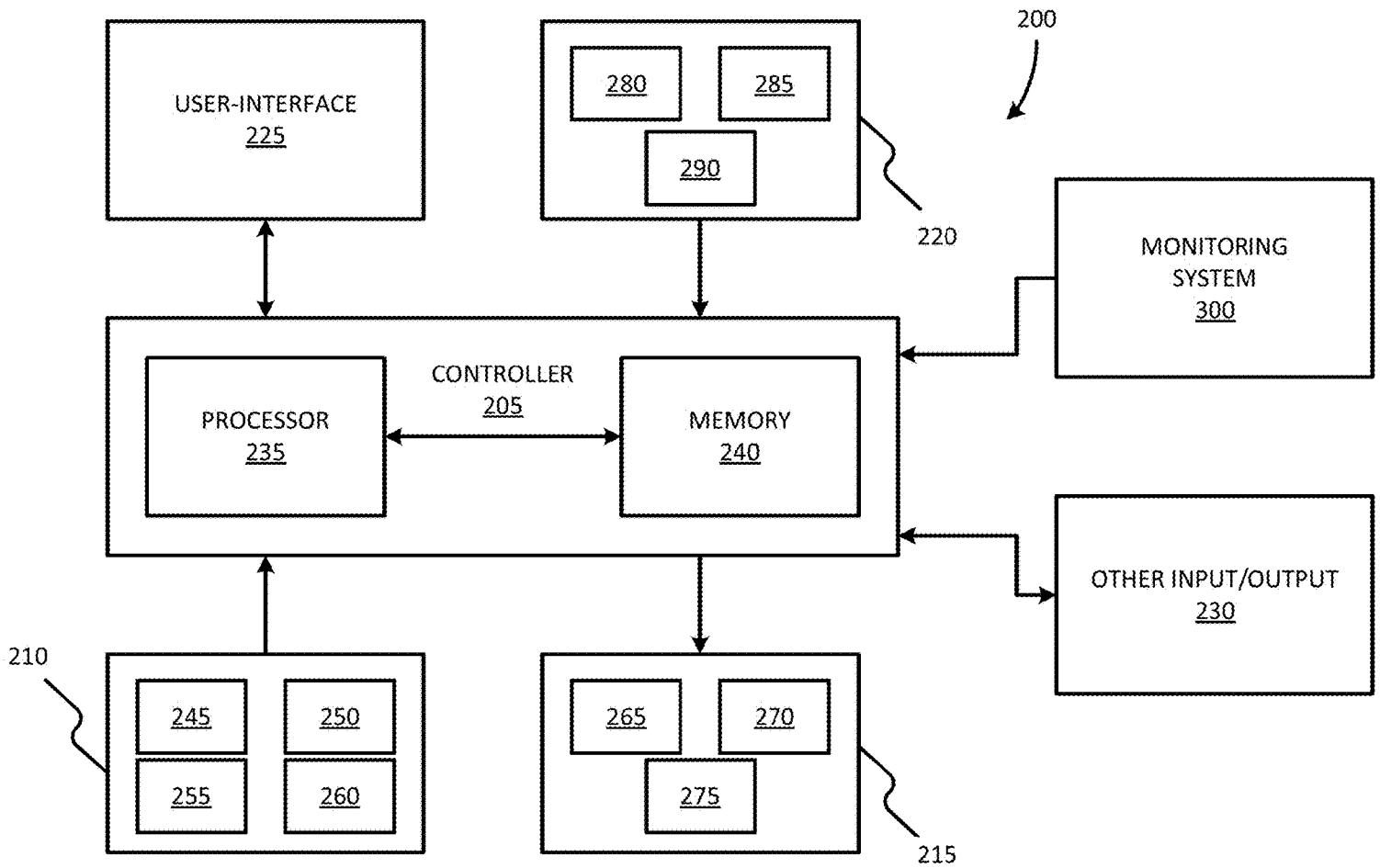
FIG. 2 illustrates a block diagram of a control system of the electric mining shovel of FIG. 1.

As shown in FIG. 2, the mining shovel 100 includes a control system 200. The control system 200 includes a controller 205, operator controls 210, dipper controls 215, sensors 220, a user-interface 225, and other input/outputs 230. The controller 205 includes a processor 235 and memory 240. The memory 240 stores instructions executable by the processor 235 and various inputs/outputs for, e.g., allowing communication between the controller 205 and the operator or between the controller 205 and sensors 220. The memory 240 includes, for example, a program storage area and a data storage area. The program storage area and the data storage area can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices. The processor 235 is connected to the memory 240 and executes software instructions that are capable of being stored in the memory 240. Software included in the implementation of the mining shovel 100 can be stored in the memory 240 of the controller 205. The software includes, for example, firmware, one or more applications, program data, filters, rules, one or more program modules, and other executable instructions. The controller 205 is configured to retrieve from memory 240 and execute, among other things, instructions related to the control processes and method described herein. In some instances, the controller 205 includes one or more of a microprocessor, digital signal processor (DSP), field programmable gate array (FPGA), application specific integrated circuit (ASIC), or the like.

The controller 205 receives input from the operator controls 210. The operator controls 210 include a crowd control 245, a swing control 250, a hoist control 255, and a door control 260. The crowd control 245, swing control 250, hoist control 255, and door control 260 include, for instance, operator controlled input devices such as joysticks, levers, foot pedals, and other actuators. The operator controls 210 receive operator input via the input devices and output digital motion commands to the controller 205. The motion commands include, for example, hoist up, hoist down, crowd extend, crowd retract, swing clockwise, swing counterclockwise, dipper door release, left track forward, left track reverse, right track forward, and right track reverse.

Upon receiving a motion command, the controller 205 generally controls dipper controls 215 as commanded by the operator. The dipper controls 215 include one or more crowd motors 265, one or more swing motors 270, and one or more hoist motors 275. For instance, if the operator indicates via swing control 250 to rotate the handle 135 counterclockwise, the controller 305 will generally control the swing motor 270 to rotate the handle 135 counterclockwise. However, in some embodiments of the application the controller 205 is operable to limit the operator motion commands and generate motion commands independent of the operator input.

The controller 205 is also in communication with a number of sensors 220 to monitor the location and status of the dipper 140. For example, the controller 205 is in communication with one or more crowd sensors 280, one or more swing sensors 285, and one or more hoist sensors 290. The crowd sensors 280 indicate to the controller 205 the level of extension or retraction of the dipper 140. The swing sensors 285 indicate to the controller 205 the swing angle of the handle 135. The hoist sensors 290 indicate to the controller 205 the height of the dipper 140 based on the hoist cable 155 position. In other embodiments there are door latch sensors which, among other things, indicate whether the dipper door 145 is open or closed and measure weight of a load contained in the dipper 140

The user-interface 225 provides information to the operator about the status of the mining shovel 100 and other systems communicating with the mining shovel 100. The user-interface 225 includes one or more of the following: a display (e.g. a liquid crystal display (LCD)); one or more light emitting diodes (LEDs) or other illumination devices; a heads-up display (e.g., projected on a window of the cab 115); speakers for audible feedback (e.g., beeps, spoken messages, etc.); tactile feedback devices such as vibration devices that cause vibration of the operator's seat or operator controls 210; or another feedback device.

Figure 3:
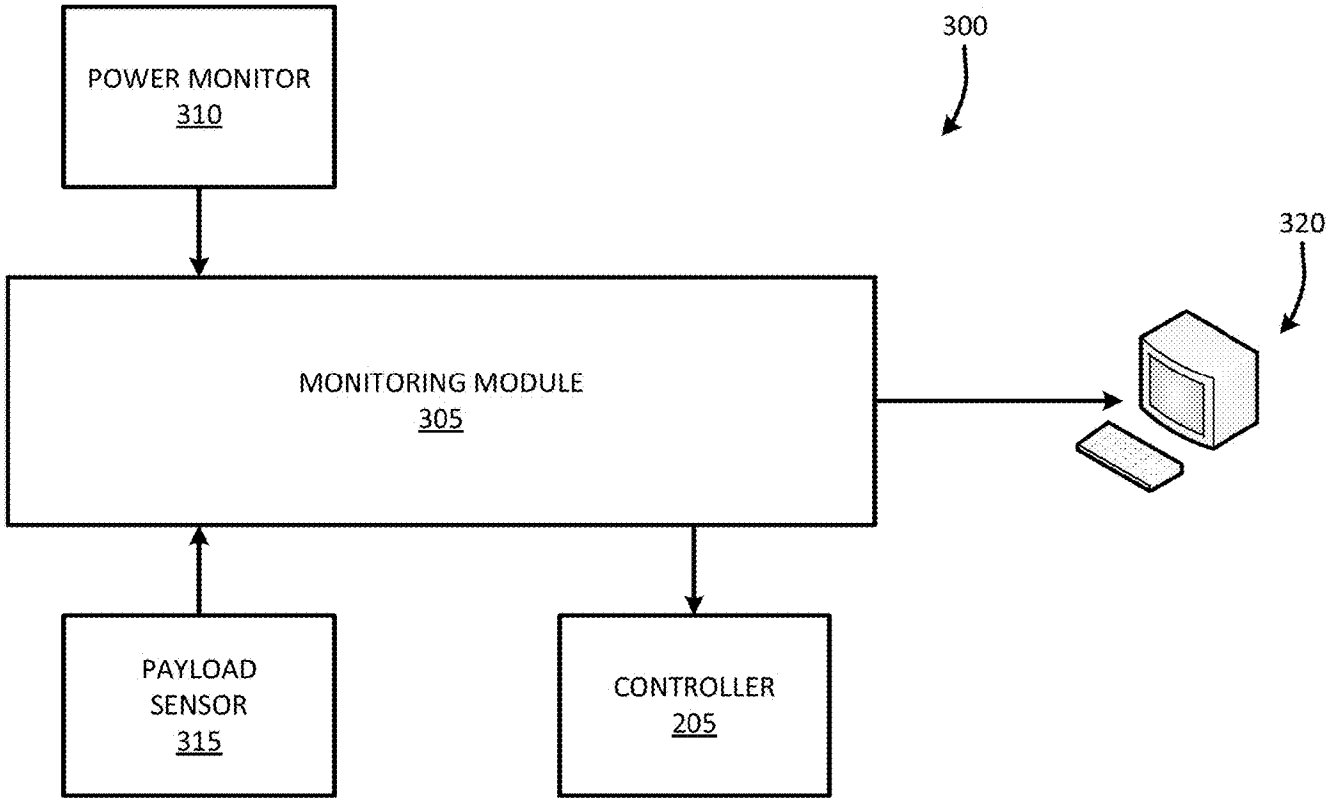
FIG. 3 illustrates a block diagram of a monitoring system of the electric mining shovel.

FIG. 3 illustrates a block diagram of a monitoring system 300. The monitoring system 300 includes a monitoring module 305, a power monitor 310, and a payload sensor 315. The monitoring module 305 includes a processor and memory. The processor executes instructions stored on the memory for analyzing and processing the received data from the power monitor 310 and payload sensor 315. In some instances the monitoring module 305 is a microprocessor, digital signal processor (DSP), field programmable gate array (FPGA), application specific integrated circuit (ASIC), or the like. In some embodiments, the monitoring system 300 outputs processed data to the controller 205. In some embodiments, the monitoring system 300 is further connected to a network 320. The network 320 may be a local area network, a wide area network, a wireless network, the Internet, or the like.

The power monitor 310 is a power and energy monitor. The power monitor 310 continuously monitors the power consumption of the mining shovel 100. In some embodiments, the power monitor 310 measures the received power from the external power source. In some embodiments, the power monitor 310 is a commercially available power meter. In some embodiments, the power monitor 310 measures the energy consumption in kilowatt-hours.

The payload sensor 315 measures the shovel payload data. The shovel payload data includes the weight of the load contained within the dipper 140. In some embodiments, the payload sensor 315 is the weight sensor of the dipper 140 discussed above. In some embodiments, the payload sensor 315 outputs the weight of the load in tons.

The monitoring module 305 receives the power consumption data from the power monitor 310 and the shovel payload data from the payload sensor 315. The monitoring module 305 processes the power consumption data and the shovel payload data. In one embodiment, the processing includes comparing the power consumption data and the shovel payload data and generating shovel efficiency data. In some embodiments, the shovel efficiency data can be a value in Tons/kWh. The monitoring module 305 may further track power consumption, payload, shovel efficiency data for a mining shovel 100 over time and generate graphs and tables of the data, as discussed in more detail below with respect to FIGS. 5-6.

In some embodiments, the monitoring module 305 is located remotely from the shovel 100 having the power monitor 310 and payload sensor 315. In these embodiments, the payload data and power consumption data are transmitted to the monitoring module 305, for instance, via a network. The network may include one or more servers, local area networks (LANs), wide area networks (WANs), the Internet, wireless connections, wired connections, etc. In these embodiments, the shovel efficiency data can be generated and displayed offsite. In these embodiments, the monitoring module 305 may receive payload and power consumption data from multiple mining machines and generate shovel efficiency data for each respective mining shovel 100.

Figure 4:
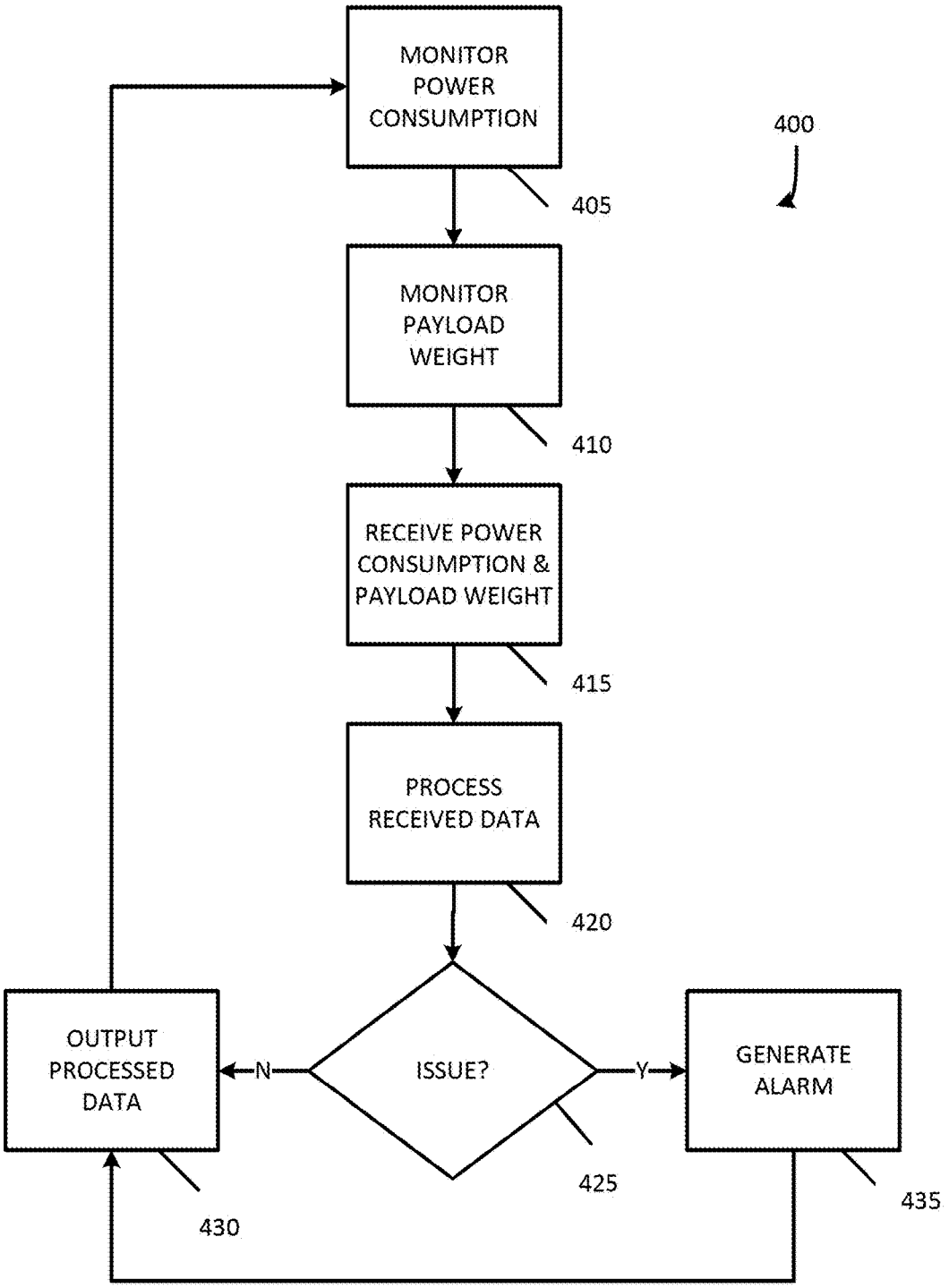
FIG. 4 illustrates a flow chart of one embodiment of the operation of the monitoring system of FIG. 3.

FIG. 4 is a flow chart 400 illustrating one embodiment of the operation of the monitoring system 300. The power monitor 310 continuously monitors the power consumption of the mining shovel 100 (Step 405). The payload sensor 315 continuously monitors the weight of the load in the dipper 145 (Step 410). The monitoring module 305 receives the power consumption from the power monitor 310 and the payload data from the payload sensor 315 (Step 415). The monitoring module 305 processes the data by comparing the power consumption to the payload data (Step 420). Next, the monitoring system 300 or a technician determines if the processed data indicates an issue, such as the processed data being outside a predetermined data range, which may indicate a sensor failure (Step 425). If there is not an issue, the monitoring module 305 outputs the processed data to the user-interface 225 and/or the network 320 (Step 430). If there is an issue, the monitoring system 300 generates an alarm (Step 435) before proceeding to outputting the processed data in Step 430. Once the data is processed, the processed data can be sent to an off-site location for further analysis.

Figure 5:
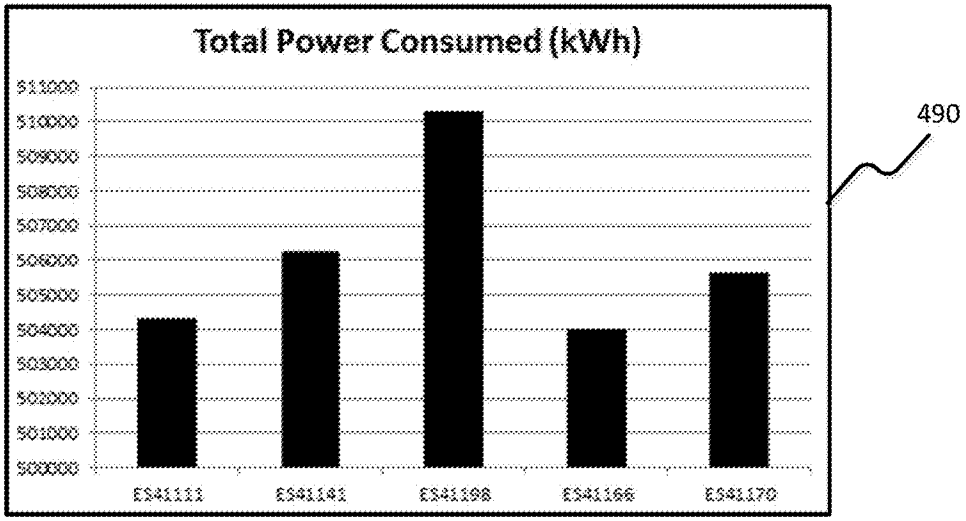
FIG. 5 illustrates an embodiment of processed data of the monitoring system.

FIG. 5 illustrates an embodiment of the processed data 450. The processed data 450 includes a "Machine" column 455, a "Tons/kWh" column 460, a "Total Power Consumed (kWh)" column 465, a "Max Power Demand (kVA)" column 470, an "Average Power Demand (kVA)" column 475, a "Max Voltage (V)" column 480, and a chart 490. The "Machine" column 455 includes several mining shovels 100 that are being monitored. The "Tons/Kwh" column 460 illustrates the processed data (the shovel efficiency data), comparing the power consumption to the payload data, for a particular mining shovel 100. The "Total Power Consumed (kWh)" column 465 illustrates the total power consumed for a particular mining shovel 100. The "Max Power Demand (kVA)" column 470 illustrates the maximum power demanded by a particular mining shovel 100. The "Average Power Demand (kVA)" column 475 illustrates the power demand of a particular mining shovel 100 averaged over the time of operation of the mining shovel 100. The "Max Voltage (V)" column 480 illustrates the maximum voltage for each mining shovel 100. In another embodiment, the processed data 450 includes an "Average Voltage (V)" column, which illustrates the voltage of each mining shovel 100 average over the time of operation. In one embodiment, the chart 490 is a bar graph illustrating column 465 on the y-axis, and one or more mining shovels 100 on the x-axis. In other embodiments, the chart 490 illustrates one or more other columns on the y-axis, such as the shovel efficiency data of column 460, and one or more mining shovels 100 on the x-axis.

Figure 6:
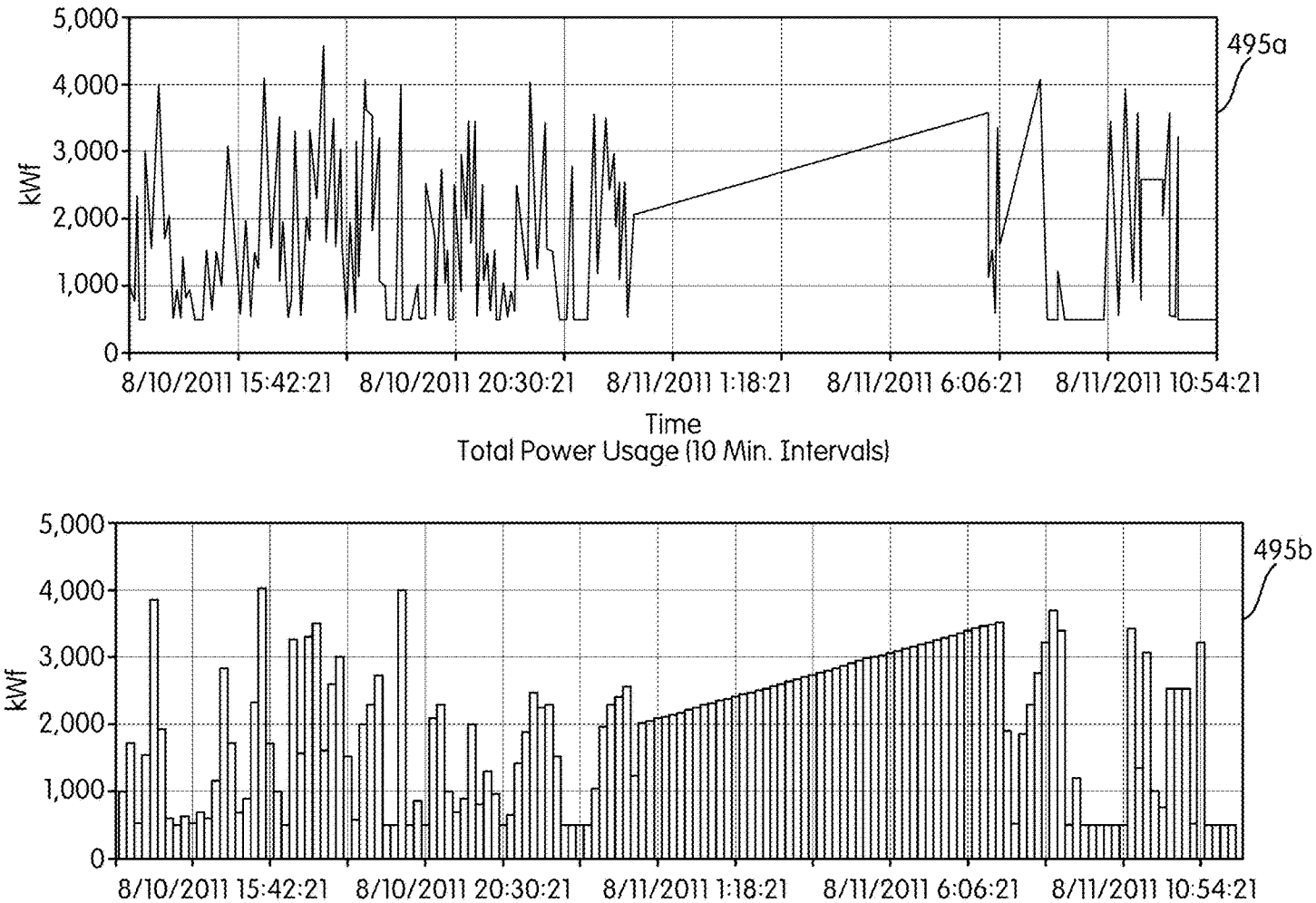
FIG. 6 illustrates an embodiment of processed data of the monitoring system.

FIG. 6 includes graphs 495*a,b*, which illustrate further embodiments of the processed data 450. The graph 495*a* illustrates the power consumed by a particular mining shovel 100 over time. The graph 495*b* illustrates the power consumed by a particular mining shovel 100 in discrete, ten-minute intervals. In some instances, the shovel efficiency data is graphed over time for a particular mining machine. The monitoring module 305 is operable to generate tables and graphs of the processed data 450, such as those shown in FIG. 5 and FIG. 6.

In some embodiments, the processed data 450 can further be broken down into specific aspects of a mining machine operation cycle (e.g., swing cycle, dig cycle, bank interaction, tuck cycle, etc.). For example, the processed data 450 can be broken down to provide shovel efficiency data based only on bank interaction or only on a swing cycle, rather than overall shovel efficiency.

Shovel efficiency data can be used by shovel operators to justify operations to internal and external parties, and to track operations to provide feedback to improve operator performance. Efficiency data can also be compared with operator performance to determine bank difficulty and digability. In some embodiments, operator performance is one or more of average shovel dig cycle time, total payload tonnage, total power consumption, and ratio of payload tonnage/power consumption. In some embodiments, operator performance is rated in tons/hour, kW/ton, or kVA/ton. Shovel efficiency data may be exported to mining drill operators, which can be used by the drill operators to determine how to improve drilling operations in a mining area.

Shovel efficiency data can further be used in conjunction with other systems and methods for determining optimal digging operations. For example, shovel efficiency data can further be used in conjunction with a control system algorithm that optimizes torque based upon machine position and various machine feedback.

Thus, the application provides, among other things, a system and method for determining an efficiency of an electric mining shovel. Various features and advantages of the application are set forth in the following claims.

What is claimed is:

1. A mining machine comprising:

a power monitor configured to measure a received power, and generate a total power consumption data based on the received power;

a sensor sensing payload of the mining machine to generate payload data; and a monitoring module including non-transitory computer readable media for comparing the total power consumption data and the payload data to generate mining machine efficiency data, determining an operator performance, comparing the mining machine efficiency data and the operator performance, determining, based on the comparison of the mining machine efficiency data and the operator performance, at least one selected from the group consisting of a bank difficulty and a bank digability, and outputting the at least one selected from the group consisting of the bank difficulty and the bank digability.

2. The mining machine of claim 1, further comprising a user-interface that indicates the at least one selected from the group consisting of the bank difficulty and the bank digability.

3. The mining machine of claim 1, further including a network for communicating the at least one selected from the group consisting of the bank difficulty and the bank digability.

4. The mining machine of claim 3, wherein the at least one selected from the group consisting of the bank difficulty and the bank digability is displayed at a remote location.

5. The mining machine of claim 1, wherein the power monitor senses power consumption of the mining machine during further time periods to generate further total power consumption data of the mining machine, the sensor senses payload of the mining machine during the further time periods to generate further payload data, and the monitoring module compares the further total power consumption data and further payload data to generate further mining machine efficiency data.

6. The mining machine of claim 1, wherein the operator performance is one selected from the group consisting of an average shovel dig cycle time, a total payload tonnage, a total power consumption, and a ratio of payload tonnage to power consumption.

7. A method for monitoring a mining machine, the method comprising:

receiving, via a monitoring module, data from the mining machine, the data including total power consumption data of the mining machine, including a measurement of a received power from an external power source coupled to the mining machine, received from a power monitor, and payload data of the mining machine received from a sensor;

comparing, via the monitoring module, the total power consumption data and the payload data to generate mining machine efficiency data;

determining, via the monitoring module, an operator performance;

comparing, via the monitoring module, the mining machine efficiency data and the operator performance;

determining, via the monitoring module and based on the comparison of the mining machine efficiency data and the operator performance, at least one selected from the group consisting of a bank difficulty and a bank digability; and outputting the at least one selected from the group consisting of the bank difficulty and the bank digability.

8. The method of claim 7, wherein the mining machine efficiency data is associated with a mining machine operation cycle, the mining machine operation cycle being at least one selected from the group consisting of a hoist, a crowd, and a swing.

9. The method of claim 7, further comprising receiving, by the monitoring module, data from a second mining machine, the data including a second total power consumption data of the second mining machine, a second operator performance of the second mining machine, and a second payload data of the second mining machine;

comparing, by the monitoring module, the second total power consumption data and the second payload data to generate second mining machine efficiency data;

comparing, via the monitoring module, the second mining machine efficiency data and the second operator performance;

determining, via the monitoring module and based on the comparison of the second mining machine efficiency data and the second operator performance, at least one selected from the group consisting of, a second bank difficulty and a second bank digability; and outputting the at least one selected from the group consisting of the second bank difficulty and the second bank digability.

10. The method of claim 7, wherein the steps of receiving and comparing the total power consumption data and the payload data are performed by a monitoring module on the mining machine.

11. The method of claim 7, wherein the steps of receiving and comparing are performed by a monitoring module remote from the mining machine.

12. The method of claim 7, further comprising displaying the at least one selected from the group consisting of the bank difficulty and the bank digability on a display remote from the mining machine.

13. The method of claim 7, further comprising displaying the at least one selected from the group consisting of the bank difficulty and the bank digability on a user-interface of the mining machine.

14. The method of claim 7, wherein determining the operator performance includes determining one selected from the group consisting of an average shovel dig cycle time, a total payload tonnage, a total power consumption, and a ratio of payload tonnage to power consumption.

15. A monitoring module for monitoring a mining machine, the monitoring module comprising:

a memory including a program storage area and a data storage area, the program storage area and the data storage area including at least one of a read-only memory, a random access memory, a flash memory, and a hard disk; and a processor executing instructions stored on the memory, the instructions including receiving a total power consumption data from the mining machine, including a measurement of a received power, receiving payload data from the mining machine, comparing the total power consumption data and the payload data to generate mining machine efficiency data, determining an operator performance, comparing the mining machine efficiency data and the operator performance, determining, based on the comparison of the mining machine efficiency data and the operator performance, at least one selected from the group consisting of a bank difficulty and a bank digability, and outputting the at least one selected from the group consisting of the bank difficulty and the bank digability.

16. The monitoring module of claim 15, further coupled to a user-interface of the mining machine that receives and indicates the at least one selected from the group consisting of the bank difficulty and the bank digability.

17. The monitoring module of claim 16, further coupled to a network for communicating the at least one selected from the group consisting of the bank difficulty and the bank digability to a remote device.

18. The monitoring module of claim 17, wherein the at least one selected from the group consisting of the bank difficulty and the bank digability is displayed on the remote device.

19. The monitoring module of claim 15, wherein the operator performance is one selected from the group consisting of an average shovel dig cycle time, a total payload tonnage, a total power consumption, and a ratio of payload tonnage to power consumption.

* * * * *